US007374267B2

(12) United States Patent
Oshio et al.

(10) Patent No.: US 7,374,267 B2
(45) Date of Patent: May 20, 2008

(54) INKJET PRINTING APPARATUS AND INKJET PRINTING METHOD

(75) Inventors: Naomi Oshio, Kawasaki (JP); Minoru Teshigawara, Yokohama (JP); Kiichiro Takahashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 411 days.

(21) Appl. No.: 11/145,959

(22) Filed: Jun. 7, 2005

(65) Prior Publication Data

US 2005/0270323 A1 Dec. 8, 2005

(30) Foreign Application Priority Data

Jun. 8, 2004 (JP) ..... 2004-170450

(51) Int. Cl.
*B41J 29/38* (2006.01)

(52) U.S. Cl. ..... 347/14; 347/37

(58) Field of Classification Search ..... 347/35, 347/60, 14, 37

See application file for complete search history.

(56) References Cited

U.S. PATENT DOCUMENTS 4,723,129 A 2/1988 Endo et al.
6,345,878 B1 * 2/2002 Kanaya ..... 347/23
6,565,184 B1 * 5/2003 Numata et al. ..... 347/23
6,663,216 B2 * 12/2003 Kanaya ..... 347/23
6,808,247 B2 10/2004 Kawatoko et al.

FOREIGN PATENT DOCUMENTS

| | | |
|---|---|---|
| JP | 08-197744 | 8/1996 |
| JP | 8-290562 | 11/1996 |
| JP | 10/278299 | 10/1998 |
| JP | 11-157101 | 6/1999 |
| JP | 2003-039693 | 3/2003 |
| JP | 2003-136755 | 5/2003 |

* cited by examiner

*Primary Examiner*—Thinh Nguyen
(74) *Attorney, Agent, or Firm*—Fitzpatrick, Cella, Harper & Scinto

(57) ABSTRACT

In an inkjet printing apparatus, as positions where preliminary discharge is performed to cause a printhead to discharge ink irrespective of printing, first and second preliminary discharge performing positions are provided within the moving area of a carriage, and a position or a combination of positions where preliminary discharge is performed is set from the first and second preliminary discharge performing positions on the basis of the information of the size and position of a printing medium. This makes it possible to simplify control concerning the setting of preliminary discharge performing positions and reduce the load on the printing apparatus.

8 Claims, 6 Drawing Sheets

INKJET PRINTING APPARATUS AND INKJET PRINTING METHOD

FIELD OF THE INVENTION

The present invention relates to an inkjet printing apparatus and inkjet printing method and, more particularly, to control of preliminary discharge, which causes a printhead to discharge ink irrespective of printing in an inkjet printing apparatus designed, to perform printing by scanning (on a printing medium) a carriage on which an inkjet printhead which discharges ink is mounted.

The present invention can be applied to all devices that use various kinds of printing media such as paper, cloth, leather, unwoven fabric, and metal. Specific devices to which the present invention can be applied include office equipment such as printers, copying machines, and facsimile apparatuses, industrial production machines, and the like.

BACKGROUND OF THE INVENTION

As a data output apparatus of word processors, personal computers, facsimiles and so forth, printers capable of printing desired information such as texts and images on a sheet-type printing medium, e.g., paper, film and the like, are widely utilized.

Although various printing methods are available for such printers, recently an inkjet printing method has particularly attracted attention because of its capability to perform non-contact printing on a printing medium such as paper, ease of color printing, and low noise. Moreover, for a configuration of such a printer, in general a serial printing method is widely adopted because of its low cost and ease of downsizing. According to the serial printing method, a printhead discharging ink in accordance with desired printing data is attached to a carriage and printing is performed by reciprocally scanning the carriage in a direction crossing to the conveyance direction of the printing medium (e.g., paper).

The inkjet printing scheme is designed to print on a printing medium by discharging small ink droplets using various kinds of ink discharge methods such as an electrostatic suction scheme implemented by the application of high voltages, a piezoelectric scheme of mechanically vibrating or displacing ink (colored ink) by using piezoelectric elements, and a thermal scheme using the pressure generated when ink forms bubbles as it is heated. This scheme produces little noise during printing, and allows high resolution, high speed printing by using a printhead having ink orifices formed at a high density. Printing apparatuses using such an inkjet printing scheme are in widespread use even in homes. It has therefore become popular that photos taken by digital cameras are printed by inkjet printing apparatuses. Further, in recent years, an inkjet printing apparatus, which can print photographs by directly connecting with a digital camera, so as not to use PCs when printing photographs taken by the digital camera has been proposed.

As digital cameras have been in widespread use, strong demands have arisen for more inexpensive, higher performance inkjet printing apparatuses.

An inkjet printing apparatus is designed to print by discharging liquid ink toward a printing medium through small holes (nozzles) formed in the printhead. It is, however, known that since ink is a liquid, when the nozzles are exposed to the atmosphere, the ink in the nozzles increases in viscosity and solidifies.

As ink increases in viscosity and solidifies, a discharge failure, e.g., the occurrence of the landing position offset of an ink droplet or a non-discharge state in which no ink droplet is discharged, occurs, resulting in a deterioration in the quality of a printed image. In order to prevent this, the inkjet printing apparatus has a recovery mechanism for setting the apparatus in a good discharge state. This mechanism performs suction recovery operation of producing negative pressure in the printhead by suction or pressurization, thereby discharging ink in the printhead, or preliminary discharge operation of discharging ink irrespective of printing. Such recovery operation is performed when a predetermined period of time has elapsed while the nozzles are exposed to the atmosphere. In this operation, ink which has increased in viscosity and solidified is discharged outside the nozzles.

In general, preliminary discharge is performed at a predetermined position, e.g., a cap which is provided near the home position and also used for suction recovery or a preliminary discharge port provided on the opposite side of the printing area to the home position.

Caps for suction recovery are indispensable for inkjet printing apparatuses, and hence printing apparatuses have them. In contrast, a preliminary discharge port is preferably provided with a member which absorbs ink, and is not used for anything other than preliminary discharge, and hence some printing apparatuses are designed without a preliminary discharge port in consideration of the cost and space required for the printing apparatus. With this arrangement, preliminary discharge is performed only at the preliminary discharge port.

In addition, since a cap has a mechanism for suction recovery, ink (including pigment ink) discharged by preliminary discharge can be discharged outside the cap. In contrast, a preliminary discharge port often has no suction mechanism. If, therefore, pigment ink is preliminarily discharged through the preliminary discharge port, the pigment ink solidifies into stalactite-like clusters and is deposited. As the degree of deposition increases, the deposit comes into contact with the discharge surface of the printhead or the like. This damages the discharge surface or the like.

For the above reason, a printing apparatus which discharges pigment ink is designed to mainly perform preliminary discharge only at the cap.

Since preliminary discharge is performed independently of normal printing operation, it takes time in addition to the time for printing. For this reason, as the number of times of preliminary discharge increases, the throughput decreases. As described above, preliminary discharge has great influence on the throughput.

In general, however, preliminary discharge intervals are determined by the ink and printhead to be used for printhead. If, therefore, the preliminary discharge intervals are simply prolonged, a discharge failure tends to occur due to an increase in viscosity of ink and its solidification.

Under the circumstances, there have been proposed preliminary discharge control methods which improve throughput by optimizing control and eliminating wasteful operation.

For example, in a printing apparatus having, as positions where preliminary discharge is to be performed, two positions, i.e., the position of a cap provided near the home position and a preliminary discharge port provided on the opposite side to the cap within the moving area of a carriage, when a signal for designating preliminary discharge operation is received, the time required to transfer print data to be printed by the next scanning operation is compared with the time required for movement to a position where preliminary discharge can be done next, and control is performed to select one of the preliminary discharge positions which corresponds to a shorter time (Japanese Patent Laid-Open No. 2003-136755).

In that control method, however, since two times like those described above are calculated, compared, and selected for each scanning operation, the load on a controller (a control unit including a CPU) which performs processing increases.

It is therefore necessary to use high-performance, expensive components with high throughput for the controller, resulting in an increase in the cost of the apparatus. In addition, if the above control is applied to an inkjet printing apparatus having a control with low processing throughput, a desired throughput cannot be obtained because of a decrease in processing speed.

SUMMARY OF THE INVENTION

It is an object of the present invention to reduce the cost of an inkjet printing apparatus having two positions for the execution of preliminary discharge by simplifying the control of the preliminary discharge performing positions without decreasing the throughput.

In order to achieve the above object, according to an aspect of the present invention, there is provided an inkjet printing apparatus which performs printing by scanning, on a printing medium, a carriage on which a printhead which discharges ink is mounted. The apparatus comprises preliminary discharge means for performing preliminary discharge to cause the printhead to discharge ink irrespective of printing, a first preliminary discharge performing position and a second preliminary discharge performing position where the preliminary discharge is performed within a moving area of the carriage, and preliminary discharge position setting means for setting a position or a combination of positions where preliminary discharge is performed by the preliminary discharge means, from the first preliminary discharge performing position and the second preliminary discharge performing position on the basis of information of a size and position of a printing medium.

According to the present invention, in an inkjet printing apparatus which performs printing by scanning, on a printing medium, a carriage on which an inkjet printhead which discharges ink is mounted, first and second preliminary discharge performing positions are provided within the moving area of a carriage as positions where preliminary discharge is performed to cause the printhead to discharge ink irrespective of printing, and a position or a combination of positions where preliminary discharge is performed is selected from the first and second preliminary discharge performing positions on the basis of the information of the size and position of the printing medium.

With this operation, since a preliminary discharge performing position is set on the basis of the information of the size and position of a printing medium, control concerning setting of a preliminary discharge performing position is simplified, thereby reducing the load on the printing apparatus.

This eliminates the necessity to use any expensive component with a high processing speed, thereby greatly reducing the cost of the overall apparatus.

In an inkjet printing apparatus with low processing throughput as well, a preliminary discharge performing position can be properly controlled without decreasing the throughput. This allows to expect an increase in throughput as compared with a case wherein conventional preliminary discharge position selection processing is performed.

The information of the size and position of the printing medium may be acquired from control data transmitted from a host device together with image data to be printed.

The apparatus may further comprise detection means for detecting end portions of a printing medium, and wherein the information of the size and position of the printing medium may be obtained from a detection result obtained by the detection means.

The preliminary discharge position setting means may set one of the first preliminary discharge performing position and the second preliminary discharge performing position as a preliminary discharge performing position when the size of the printing medium is not more than ½ a maximum scanning width of the carriage, and may set both the first preliminary discharge performing position and the second preliminary discharge performing position as preliminary discharge performing positions in other cases.

The preliminary discharge position setting means may acquire the information of the position of the printing medium from a type of printing medium on which printing is to be performed.

The first preliminary discharge performing position may be a position near a home position of the printhead at which recovery means for executing recovery processing for the printhead is provided, and the second preliminary discharge performing position may be a position which is provided on an opposite side to the first preliminary discharge performing position within the moving area of the carriage.

The printhead may be a printhead which discharges ink by using thermal energy, and comprises a thermal energy transducer which generates thermal energy to be applied to ink.

In order to achieve the above object, according to another aspect of the present invention, there is provided an inkjet printing apparatus which performs printing on a plurality of types of printing media by scanning, on the printing media, a carriage on which a printhead which discharges ink is mounted. The apparatus comprises preliminary discharge means for performing preliminary discharge to cause the printhead to discharge ink irrespective of printing, a first preliminary discharge performing position and a second preliminary discharge performing position at which the preliminary discharge is performed within a moving area of the carriage, and preliminary discharge position setting means for setting a position or a combination of positions where preliminary discharge is performed by the preliminary discharge means, from the first preliminary discharge performing position and the second preliminary discharge performing position on the basis of information of a size and type of a printing medium.

In order to achieve the above object, according to further aspect of the present invention, there is provided an inkjet printing apparatus which performs printing on a plurality of types of printing media by scanning, on the printing media, a carriage on which a printhead which discharges ink is mounted. The apparatus comprises preliminary discharge means for performing preliminary discharge to cause the printhead to discharge ink irrespective of printing, a control unit which controls preliminary discharge operation by the preliminary discharge means, and a plurality of preliminary discharge receiving portions which receive ink discharged from the printhead by the preliminary discharge operation within a moving area of the carriage, wherein the control unit makes a preliminary discharge receiving portion used when printing is performed in a predetermined printing mode of the plurality of printing modes differ from a preliminary discharge receiving portion used when printing is performed in a printing mode different from the predetermined printing mode.

Note that the above objects are also achieved by an inkjet printing method corresponding to any one of the above inkjet printing apparatus, a computer program which causes a computer to execute the inkjet printing method, or a storage medium which stores the computer program.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings. Note that each elements in the following embodiments is not intended to limit the scope of the invention, but is described only as an example.

In this specification, "print" is not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Further, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

Moreover, "nozzle" should be interpreted as any combination of a discharge opening, a channel communicating thereto and an energy-generating element used for discharging ink, without annotation.

Outline of Inkjet Printing Apparatus

An outline of an inkjet printing apparatus according to the present invention, which is common to the following embodiments, will be described first.

Figure 1:
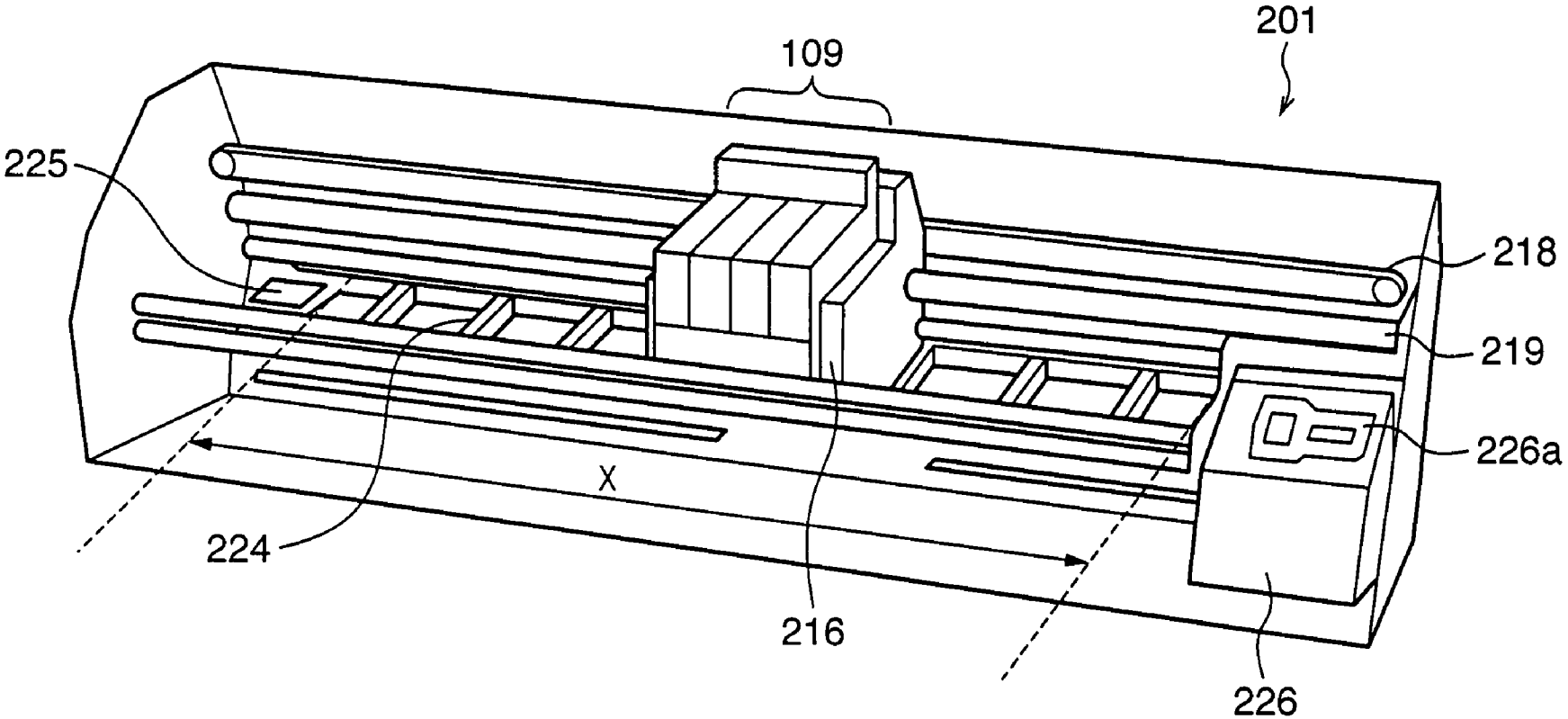
FIG. 1 is a schematic perspective view showing the arrangement of the main part of an inkjet printing apparatus which can be applied to the present invention.
Figure 2:
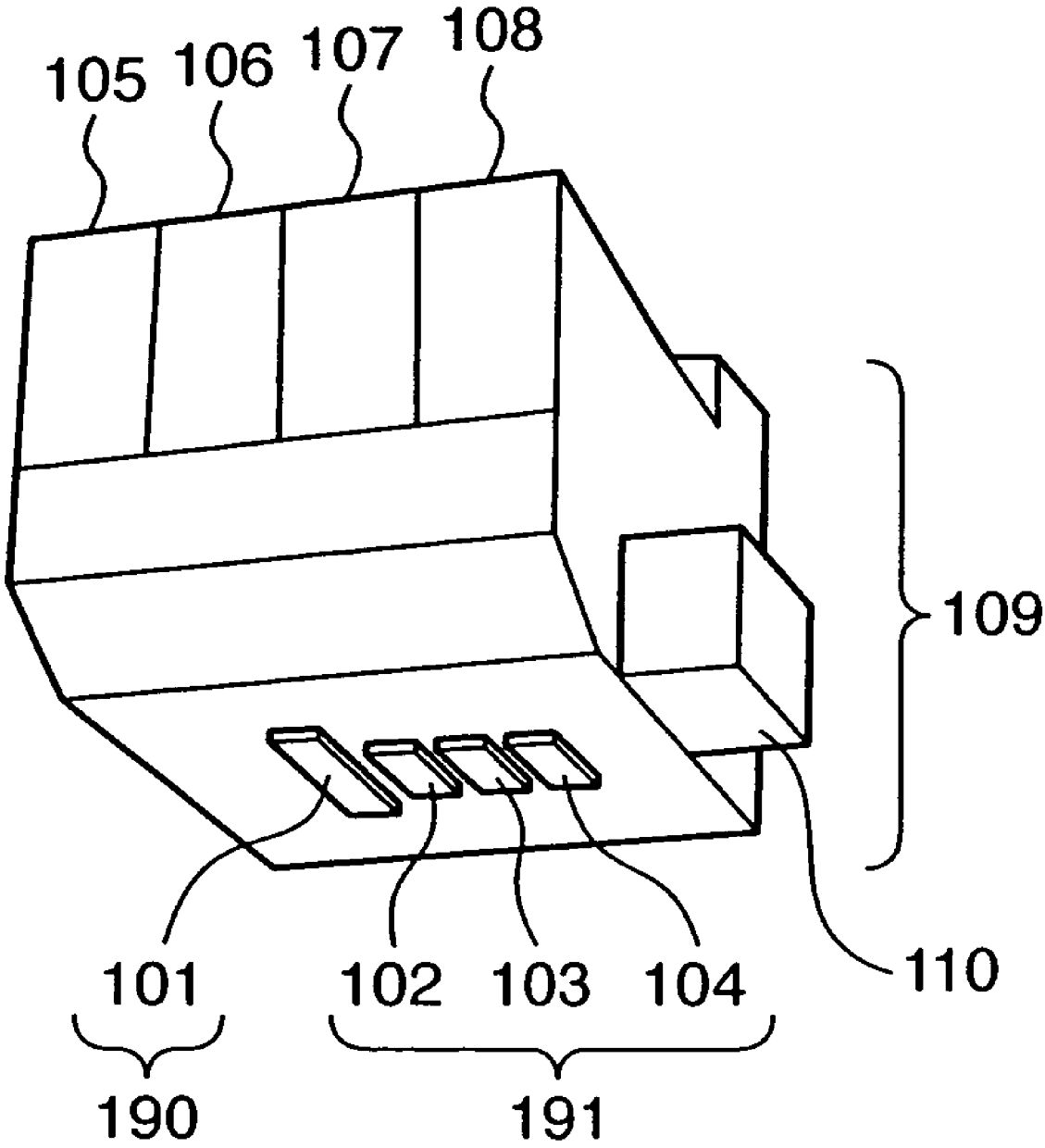
FIG. 2 is a perspective view showing the schematic outer appearance of an inkjet printhead cartridge in FIG. 1.

FIG. 1 is a perspective view showing the arrangement of the main part of the inkjet printing apparatus according to the present invention. FIG. 2 is a perspective view showing the schematic arrangement of the head cartridge of the inkjet printing apparatus in FIG. 1.

Referring to FIG. 2, reference numerals 101 to 104 denote thermal inkjet printheads which discharge inks to a printing medium by using bubbles produced by thermal energy. Each printhead has a nozzle array comprising a plurality of nozzles. Reference numeral 190 denotes a printhead unit which discharges black pigment ink; and 191, a printhead unit which discharges C (Cyan), M (Magenta), and Y (Yellow) dye inks and is formed by integrating the inkjet printheads 102 to 104 into one unit.

According to the form shown in FIG. 2, reference numerals 105 to 108 denote ink tanks respectively containing black pigment ink, cyan dye ink, magenta dye ink, and yellow dye ink; and 109, an inkjet printhead cartridge integrated with the inkjet printheads 101 to 104. Each of the ink tanks 105 to 108 can be detachably mounted in the inkjet printhead cartridge 109.

In the inkjet printing apparatus shown in FIG. 1, since the quality of characters printed by dye ink on plain paper is poor, pigment ink is used as black ink to improve the quality of characters printed in black on plain paper. Note that when an image such as a photo is to be printed on special paper, on labels of CD-R or DVD-R, printing is performed by using only dye ink without using this pigment ink due to the characteristics of the printing medium. Such an ink set can be arbitrarily set in accordance with the characteristics of the apparatus body. That is, the numbers and colors of dye inks and pigment inks are not specifically limited.

Referring to FIG. 2, reference numeral 110 denotes an optical printing medium detector which can be arbitrarily placed depending on an inkjet printing apparatus. This detector includes a light emitting section and light receiving section, and detects the boundary between the printing medium area and the printing apparatus body area comprising a platen 114 and the like. In general, a printing medium is higher in lightness than the apparatus body, and has a high reflectance. The detector detects an end portion of the printing medium on the basis of the electrical output difference based on these optical characteristics, thereby detecting the size of the printing medium.

The printing medium detector 110 is configured to be mounted on an arbitrary place of a carriage 216 depending on the arrangement of the inkjet printing apparatus. In this embodiment, as shown in FIG. 2, the detector is mounted on a side of a printhead cartridge 109. In addition, since a printing medium detector can be arbitrarily placed, some inkjet printing apparatuses include no such detector.

In addition, referring to FIG. 1, reference numeral 201 denotes an inkjet printing apparatus body. When the inkjet printhead cartridge 109 is mounted on a carriage 216 which detachably holds the cartridge, the inkjet printhead cartridge 109 is electrically and mechanically connected to the inkjet printing apparatus body 201.

Referring to FIG. 1, when the inkjet printhead cartridge 109 is mounted on the carriage 216, the nozzle arrays of the inkjet printheads 101 to 104 face the printing surface of a printing medium conveyed onto a platen 224. The carriage 216 is coupled to a portion of a driving belt 218 which transfers the driving force of a driving motor (304 in FIG. 3), and is made slidable on a guide shaft 219. This makes it possible for the inkjet printheads 101 to 104 to reciprocate throughout the total width of the printing medium.

By driving the inkjet printheads 101 to 104 during this reciprocal movement in accordance with reception data, an image is printed on the printing medium. Every time this main scanning operation is performed once, sub-scanning is performed to convey the printing medium by a predetermined amount.

Reference numeral 226 denotes a head recovery device, which is placed at one end of the moving path of the inkjet printheads 101 to 104, e.g., near the home position. The head recovery device 226 is operated by the driving force of a motor through a transfer mechanism to cap each of the inkjet printhead units 190 and 191. As a cap portion 226*a* of the head recovery device 226 caps the inkjet printhead units 190 and 191, ink suction (suction recovery) is performed by a suction means (suction pump) provided in the head recovery device 226. When printing is complete, capping by the cap portion 226*a* prevents the evaporation of ink from the inkjet printhead units 190 and 191 and protects the surfaces (discharge surfaces) of the inkjet printhead units.

In the moving area of the carriage, a preliminary discharge port 225 is provided on the opposite side to the position of the head recovery device 226 (cap portion 226*a*). As will be described later, in the high resolution printing mode with a low scanning speed, control is performed to perform preliminary discharge at the preliminary discharge port 225 as well as at the cap portion 226*a*.

Figure 3:
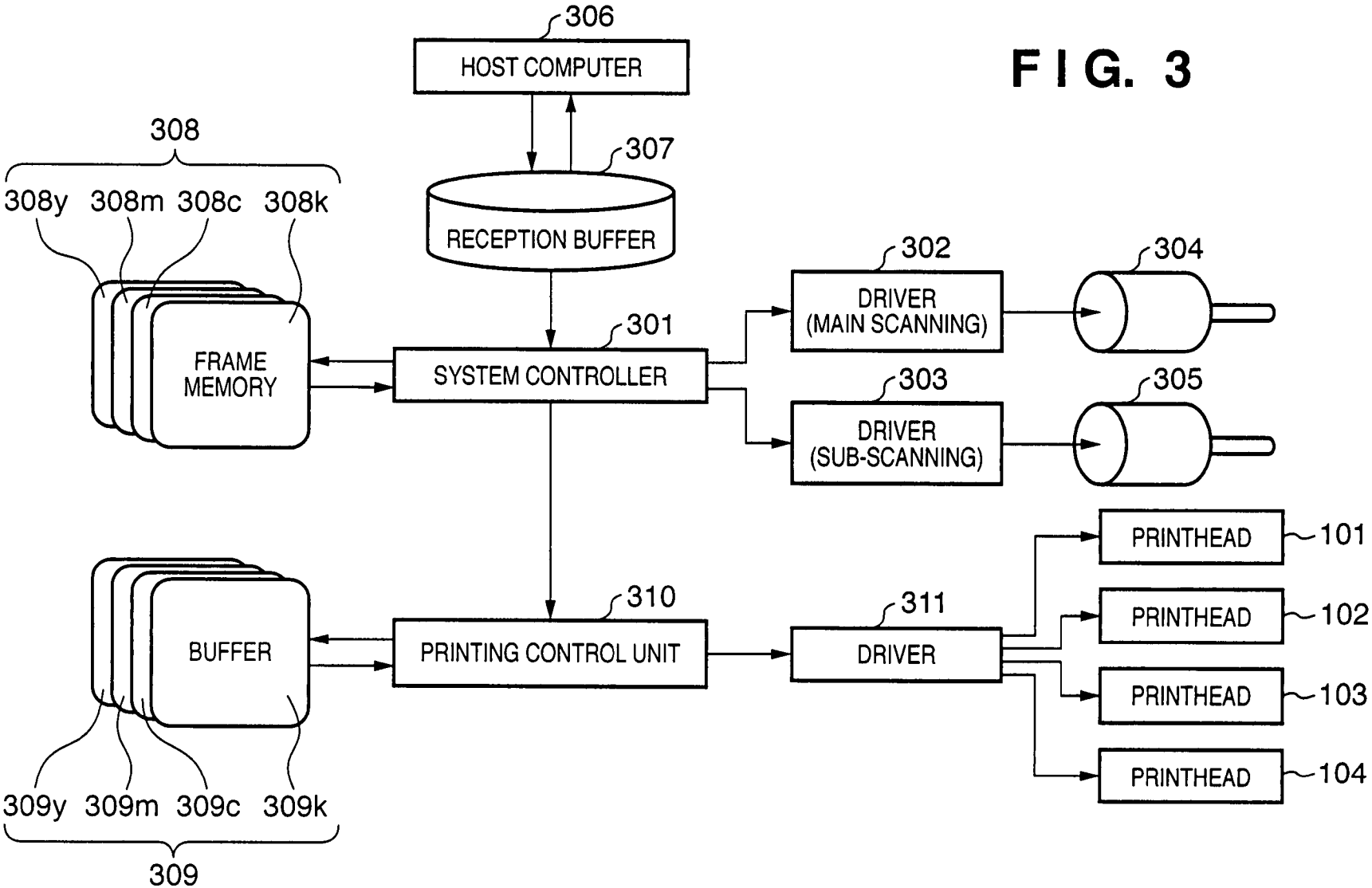
FIG. 3 is a block diagram showing the arrangement of a control system in the inkjet printing apparatus in FIG. 1.

FIG. 3 is a block diagram showing the arrangement of a control system in this inkjet printing apparatus.

Referring to FIG. 3, reference numeral 301 denotes a system controller which controls the overall apparatus and incorporates a microprocessor (MPU), a ROM in which control programs are stored, a RAM used as a work area when the microprocessor performs processing, and the like. The system controller 301 controls preliminary discharge in accordance with a control program, and designates the timing of the execution of preliminary discharge to a printing control unit 310 (to be described later). Note that main control of the inkjet printing apparatus according to the present invention, including this control of preliminary discharge and the like, is executed under the control of a host computer 306.

Reference numeral 302 denotes a driver which drives/controls a motor 304 for moving (main scanning) the carriage 216 on which the inkjet printhead cartridge is mounted. According to the present invention, the speed of the carriage 216 is decreased by controlling the driver 302. Reference numeral 303 denotes a driver in the sub-scanning direction, which drives/controls a motor 305 for conveying a printing medium in the sub-scanning direction.

The host computer 306 serving as a host device transfers print data and the like to the printer of the present invention. Reference numeral 307 denotes a reception buffer for temporarily storing data received from the host computer 306. The reception buffer 307 keeps storing the data until the system controller 301 reads in the data.

Reference numeral 308 (308*k*, 308*c*, 308*m*, 308*y*) denotes a frame memory which is provided for each ink color (black, cyan, magenta, and yellow) to convert print data into image data, and has a memory size necessary to print in a predetermined area; and 309 (309*k*, 309*c*, 309*m*, 309*y*), a buffer for temporarily storing print data corresponding to one scanning operation of the inkjet printhead. Such buffers are respectively provided for the respective ink colors (black, cyan, magenta, and yellow). The buffer 309 is used to store only print data corresponding to one scanning operation, which the host computer 306 has created by color conversion, density correction, and binarization processing and transmitted.

The printing control unit 310 controls the printheads under the control of the system controller 301. In controlling preliminary discharge according to the present invention, the printing control unit 310 receives a command from the system controller 301 described above and controls a driver 311 (to be described later). The driver 311 drives the inkjet printheads 101, 102, 103, and 104 to discharge the respective inks (black, cyan, magenta, and yellow inks). The driver 311 is controlled by a control signal from the printing control unit 310, and causes the inkjet printheads 101, 102, 103, and 104 to perform preliminary discharge.

In addition, when the printing medium detector 110 is mounted as shown in FIG. 2, the system controller 301 discriminates the length (width) of a printing medium in the scanning direction on the basis of an output signal from the printing medium detector 110.

First Embodiment

The first embodiment of the present invention in the inkjet printing apparatus having the above arrangement will be described below.

The first embodiment is directed to determine a preliminary discharge performing position on the basis of both image data to be printed and the information of a printing medium which is transmitted from a host computer.

When a user issues a print instruction during the execution of an application by the host computer, a printer driver corresponding to a connected inkjet printing apparatus is activated. The user selects or inputs a printing mode and information of a printing medium on the setting window provided by the printer driver with an input device such as a mouse or keyboard.

The printer driver generates image data in accordance with the set printing mode and the information of the printing medium, and also generates control data containing the information of the printing medium. The printer driver then transmits the generated image data and control data to the inkjet printing apparatus.

In this embodiment, the inkjet printing apparatus acquires both the image data and the information of the printing medium which is contained in the control data transmitted from the host computer, and selects a preliminary discharge performing position on the basis of the acquired information.

Figure 5:
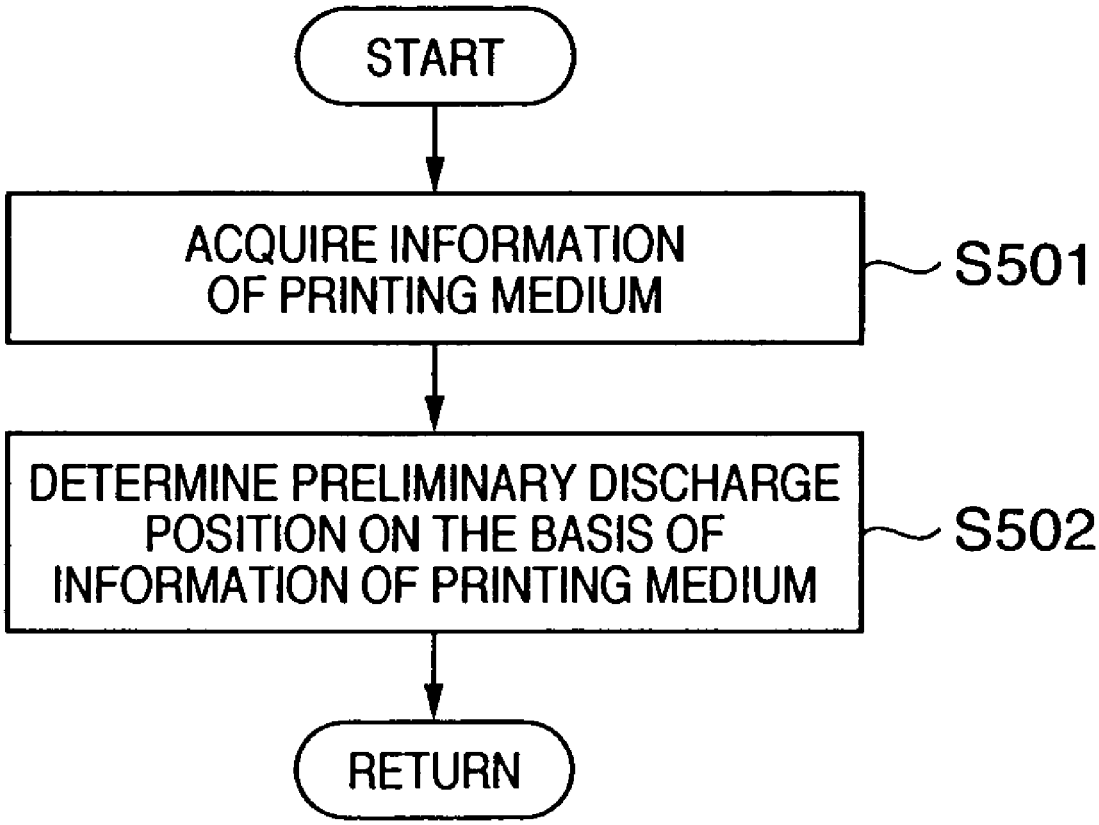
FIG. 5 is a flowchart showing a sequence for preliminary discharge control in the first embodiment.

A method of setting a preliminary discharge performing position in this embodiment will be described below with reference to the flowchart of FIG. 5. The flow shown in FIG. 5 is executed by a system controller 301. Note that this embodiment can be executed even in an inkjet printing apparatus which does not have an optical printing medium detector 110 in FIG. 3. Obviously, the embodiment can be executed in an inkjet printing apparatus having an optical printing medium detector.

As described above, information for specifying the size and type of printing medium is contained in control data transmitted together with image data from the host computer to the inkjet printing apparatus. In this embodiment, a preliminary discharge performing position is set by acquiring this information.

In step S501, the system controller 301 acquires the information of a printing medium from the control data transmitted from a host computer 306. In step S502, the system controller 301 sets a preliminary discharge performing position by referring to a table like Table 1 on the basis of the information about the type and size of the printing medium which is contained in the acquired information.

TABLE 1

| Type of Printing Medium | Size of Printing Medium | Preliminary Discharge Position |
|---|---|---|
| High-Grade Glossy Paper | L-size | only cap |
| | Postcard | only cap |
| | A4 | both cap and preliminary discharge port |
| | B5 | both cap and preliminary discharge port |
| Inexpensive Glossy Paper | L-size | only cap |
| | Postcard | only cap |
| | A4 | both cap and preliminary discharge port |
| | B5 | both cap and preliminary discharge port |
| Plain Paper | L-size | — |
| | Postcard | only cap |
| | A4 | both cap and preliminary discharge port |
| | B5 | both cap and preliminary discharge port |
| CD-R/DVD-R | CD/DVD | only preliminary discharge port |

In this embodiment, as shown in Table 1, it is assumed that four types of printing media are prepared, including high-grade glossy paper, inexpensive glossy paper, plain paper, and CD-R/DVD-R, and five printing medium sizes are set, including L-size, postcard, A4, B4, and CD/DVD. In this case, in the inkjet printing apparatus according to this embodiment, when high-grade glossy paper, inexpensive glossy paper, or plain paper is to be used, the paper is aligned with a side on the home position side. When printing is to be performed on the label surface of a CD-R or DVD-R, the CD-R or DVD-R is placed on a dedicated tray and set in the printing apparatus. The CD-R or DVD-R is placed on the tray while being aligned with a side on the opposite side to the home position.

Assume that the type of printing medium to be used is high-grade glossy paper, inexpensive glossy paper, or plain paper. In this case, if the size of the printing medium is L-size or postcard, setting is made to perform preliminary discharge only at the cap position set on the home position side. If the size of the printing medium is A4 or B5, setting is made to perform preliminary discharge at both the cap position and the preliminary discharge port. If the type of printing medium is CD-R or DVD-R, setting is made to perform preliminary discharge only at the preliminary discharge port provided on the opposite side to the home position in the moving area of the carriage.

Figure 4:
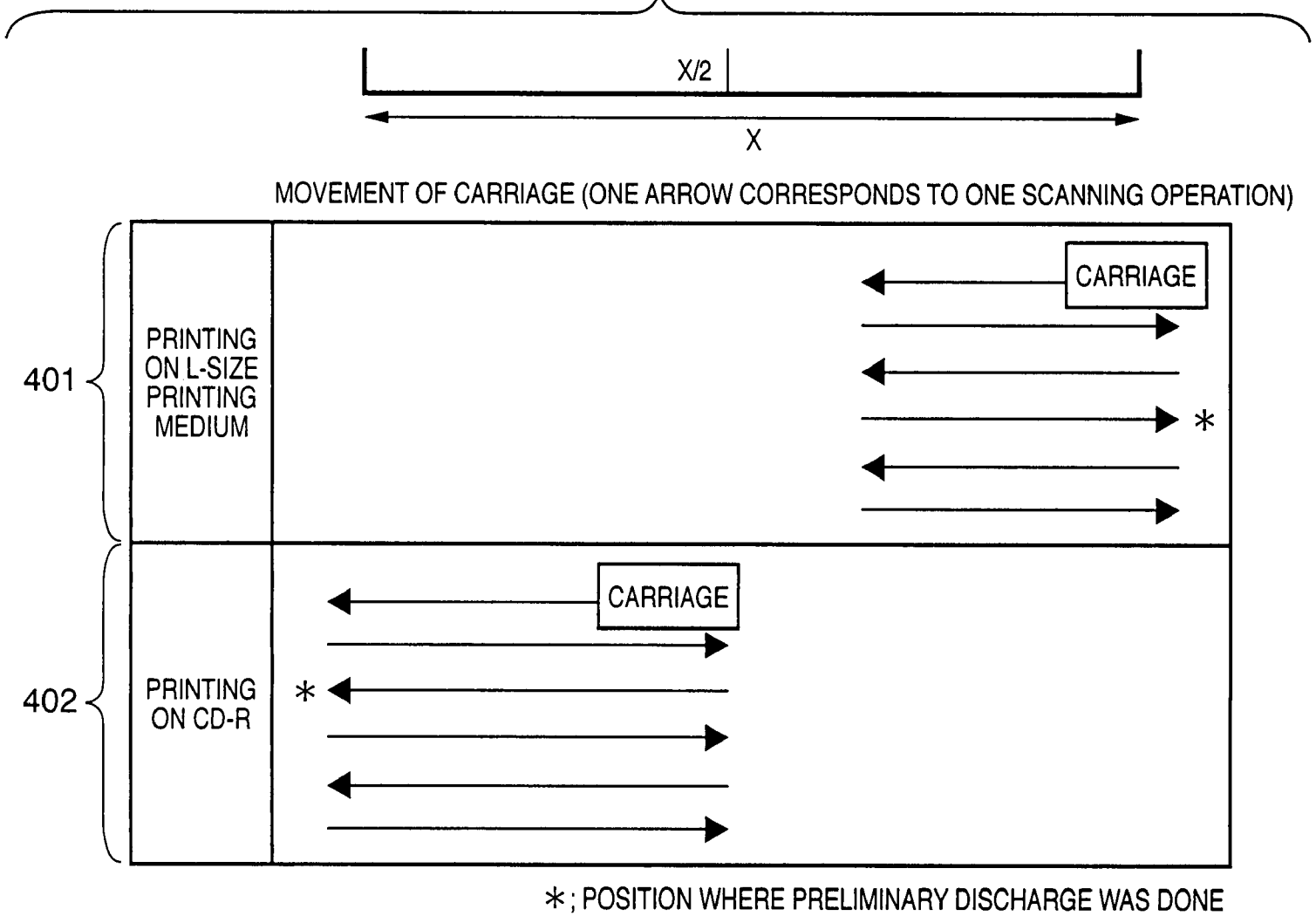
FIG. 4 is a view for explaining the relationship between a printing medium and a preliminary discharge position in the first embodiment.

FIG. 4 is a view for explaining how printing is performed in this embodiment. Reference numeral 401 denotes printing on an L-size printing medium; and 402, printing on a CD-R. Note that the right end in FIG. 4 indicates the home position.

In printing 401, since the L-size printing medium is set on the home position side, the carriage reciprocates between a position near the home position and the left end of the L-size printing medium when printing is performed. Preliminary discharge is executed at the timing when the carriage returns to the home position side every time scanning is performed a plurality of number of times.

In printing 402, since the CD-R is set on the opposite side to the home position, the carriage reciprocates between a position near the preliminary discharge port on the opposite side to the home position and the right end of the CD-R when printing is performed. Preliminary discharge is executed at the timing when the carriage returns to the preliminary discharge port side every time scanning is performed a plurality of times.

As described above, in this embodiment, a preliminary discharge performing position is set, on the basis of the type and size of printing medium to be used and a position where the medium is set, such that preliminary discharge is performed at a position near the moving area of the carriage.

In this embodiment, the system controller 301 sets a preliminary discharge performing position on the basis of the information of a printing medium which is contained in the control information received from the host computer 306. However, a printer driver installed in the host computer 306 may set a preliminary discharge performing position on the basis of the type and size of printing medium to be used, and transmit the information of the set preliminary discharge performing position to the inkjet printing apparatus upon containing the information in control information.

It should be understood that any technique of setting a preliminary discharge performing position on the basis of the information of a printing medium to be used for printing falls within the scope of the present invention.

As described above, according to the this embodiment, since a preliminary discharge performing position is set on the basis of the information of the size and position of a printing medium, control of a preliminary discharge performing position is simplified, thereby reducing the load on the system controller. This makes it possible to eliminate the necessity to use any expensive component with a high processing speed and greatly reduce the cost.

In addition, in an inkjet printing apparatus with low processing throughput, a preliminary discharge performing position can be properly controlled without decreasing the throughput. This allows to expect an increase in throughput as compared with a case wherein conventional preliminary discharge position selection processing is performed.

Second Embodiment

The second embodiment of the present invention will be described below. The second embodiment is directed to an inkjet printing apparatus similar to that of the first embodiment. A description of portions similar to those in the first embodiment will be omitted, and the characteristic portion of the second embodiment will be mainly described.

According to the second embodiment of the present invention, in an inkjet printing apparatus including an optical printing medium detector 110, the information of the size (width) and position of a printing medium is acquired from an output from the optical printing medium detector, and a preliminary discharge performing position is set on the basis of the acquired information. Note that the optical printing medium detector used in this embodiment is not limited to the one shown in FIG. 2, and detectors based on various schemes can be used as long as they can detect the width and position of a printing medium.

Figure 6:
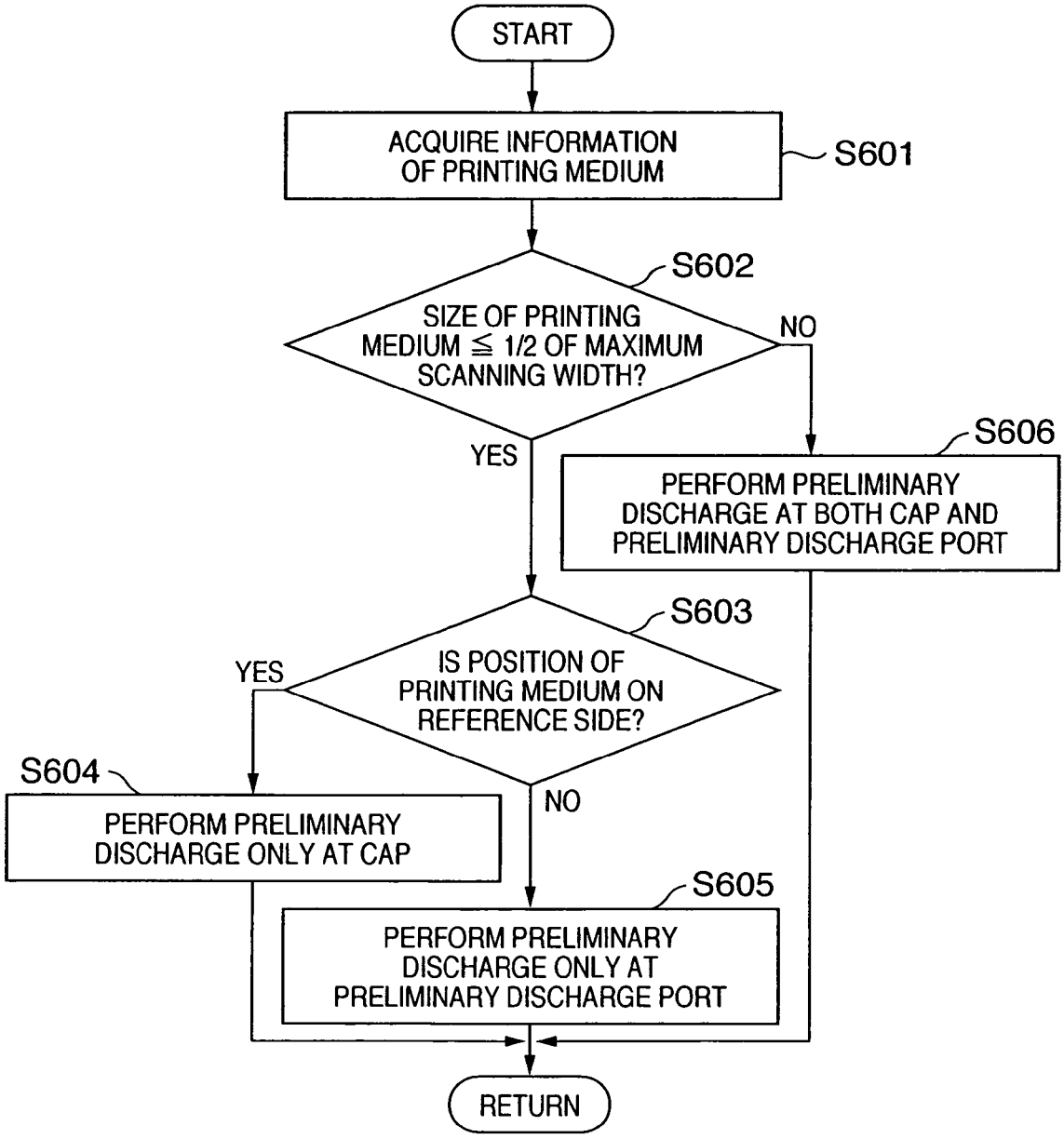
FIG. 6 is a flowchart showing a sequence for preliminary discharge control in the second embodiment.

A method of setting a preliminary discharge performing position in this embodiment will be described below with reference to the flowchart of FIG. 6. The flow shown in FIG. 6 is executed by a system controller 301.

First of all, upon receiving a preliminary discharge signal from a printing control unit 310, the system controller 301 starts a preliminary discharge sequence. In step S601, the system controller 301 detects the positions of the two ends of a printing medium by using the optical printing medium detector in step S601, and acquires the size (width) of the printing medium in the scanning direction and position information indicating whether the printing medium is set on a reference side (home position side) or a non-reference side (the opposite side to the home position).

In step S602, the system controller 301 determines whether the size (width) of the printing medium in the scanning direction is equal to or less than ½ the maximum scanning width of the carriage. If the width of the printing medium exceeds the ½ the maximum scanning width (NO), the flow advances to step S606 to make setting to perform preliminary discharge at both the cap on the reference side (home position side) and the preliminary discharge port on the opposite side to the cap.

If it is determined in step S602 that the width of the printing medium is equal to or less than ½ the maximum scanning width (YES), the flow advances to step S603 to determine, on the basis of the position information of the printing medium acquired in step S601, whether or not the printing medium is set on the reference side with respect to the scanning direction. If the printing medium is set on the reference side (YES), the flow advances to step S604 to make setting to perform preliminary discharge at the cap on the reference side. If the printing medium is not set on the reference side (NO), the flow advances to step S605 to make setting to perform preliminary discharge only at the preliminary discharge port, considering that the printing medium is set on the opposite side.

As described above, in this embodiment, a preliminary discharge performing position is set on the basis of the information of the size and position of a printing medium which is acquired by the optical printing medium detector. The setting result is similar to that in the first embodiment.

In this embodiment, however, since setting is made on the basis of the actual detection result obtained by the optical printing medium detector, it can also be determined whether or not the setting for the printing medium by the printer driver is wrong. This makes it possible to perform the following operation. It is determined whether or not the information of the printing medium transmitted from the printer driver coincide with the actual detection result. If the information differs from the actual detection result, the user is notified of the corresponding information. Even if the setting made by the printer driver is wrong, preliminary discharge can be executed at a proper position.

Assume that the optical printing medium detector determines that the width of a printing medium is L-size, which is smaller than ½ the maximum scanning width, and the set position of the printing medium is on the reference side. In this case, as in the case shown in FIG. 4, a preliminary discharge performing position is set only at the cap on the reference side.

As described above, according to this embodiment, since a preliminary discharge performing position is set on the basis of the information of the size and position of a printing medium which is actually detected, control of a preliminary discharge performing position is simplified, and the load on the system controller is reduced. This makes it possible to eliminate the necessity to use any expensive component with a high processing speed and greatly reduce the cost.

In addition, in an inkjet printing apparatus with low processing throughput, a preliminary discharge performing position can be properly controlled without decreasing the throughput. This provides an expectation of an increase in throughput as compared with a case wherein conventional preliminary discharge position selection processing is performed.

Other Embodiment

Each embodiment described above has exemplified the thermal inkjet printing apparatus. However, the present invention can be applied to printing apparatuses using any ink discharge methods. For example, the present invention can be effectively applied to an inkjet printing apparatus based on a piezoelectric scheme.

In addition, the present invention can be applied to a multifunction apparatus or system comprising a plurality of devices including a device which implements a function corresponding to an inkjet printing apparatus.

Furthermore, the invention can be implemented by supplying a software program (a program corresponding to a flowchart shown in FIG. 5 or FIG. 6), which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or scrip data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-170450, filed on Jun. 8, 2004, which is hereby incorporated by reference herein.

What is claimed is:

1. An inkjet printing apparatus which performs printing by moving, on plural types of printing media, a carriage on which a printhead which discharges ink is mounted, comprising:

preliminary discharge means for performing preliminary discharge to cause the printhead to discharge ink irrespective of printing;

a first preliminary discharge performing position and a second preliminary discharge performing position where the preliminary discharge is performed within a moving area of the carriage;

print means for printing by changing the moving area of the carriage according to a type of printing medium used, out of the plural types of printing media; and preliminary discharge position setting means for setting a position where preliminary discharge is performed by said preliminary discharge means, (i) to both the first preliminary discharge performing position and the second preliminary discharge performing position, in a case where the moving area of the carriage is longer than a predetermined length, and (ii) to a position closer to the moving area of the carriage selected from the first preliminary discharge performing position and the second preliminary discharge performing position, in a case where the moving area of the carriage is equal to or shorter than the predetermined length, on the basis of information of a size of a printing medium and the moving area of the carriage.

2. The apparatus according to claim 1, wherein the information of the size of the printing medium and the moving area of the carriage is acquired from control data transmitted from a host device together with image data to be printed.

3. The apparatus according to claim 1, further comprising detection means for detecting end portions of a printing medium, wherein the information of the size of the printing medium and the moving area of the carriage is obtained from a detection result obtained by said detection means.

4. The apparatus according to claim 1, wherein the predetermined length is ½ a maximum scanning width of the carriage.

5. The apparatus according to claim 1, wherein said preliminary discharge position setting means acquires the information of the moving area of the carriage from a type of printing medium on which printing is to be performed.

6. The apparatus according to claim 1, wherein said first preliminary discharge performing position is a position near a home position of the printhead at which recovery means for executing recovery processing for the printhead is provided, and said second preliminary discharge performing position is a position which is provided on an opposite side to said first preliminary discharge performing position within the moving area of the carriage.

7. The apparatus according to claim 1, wherein the printhead is a printhead which discharges ink by using thermal energy, and comprises a thermal energy transducer which generates thermal energy to be applied to ink.

8. An inkjet printing method which performs printing by moving, on plural types of printing media, a carriage on which a printhead which discharges ink is mounted, comprising:

providing a first preliminary discharge performing position and a second preliminary discharge performing position within a moving area of the carriage as positions where preliminary discharge is performed to cause the printhead to discharge ink irrespective of printing;

printing by changing the moving area of the carriage according to a type of printing medium used, out of the plural types of printing media; and setting a position where the preliminary discharge is executed, (i) to both the first preliminary discharge performing position and the second preliminary discharge performing position, in a case where the moving area of the carriage is longer than a predetermined length, and (ii) to a position closer to the moving area of the carriage selected from the first preliminary discharge performing position and the second preliminary discharge performing position, in a case where the moving area of the carriage is equal to or shorter than the predetermined length, on the basis of information of a size of a printing medium and the moving area of the carriage.

* * * * *